US008602529B2

(12) United States Patent
Kamiyama

(10) Patent No.: US 8,602,529 B2
(45) Date of Patent: Dec. 10, 2013

(54) LIQUID EJECTION DEVICE AND LIQUID EJECTION METHOD

(75) Inventor: Nobuaki Kamiyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/217,799

(22) Filed: Aug. 25, 2011

(65) Prior Publication Data

US 2012/0062652 A1 Mar. 15, 2012

(30) Foreign Application Priority Data

Sep. 14, 2010 (JP) ..... 2010-205230

(51) Int. Cl.
*B41J 2/14* (2006.01)
*B41J 2/165* (2006.01)

(52) U.S. Cl.
USPC ..... 347/47; 347/31; 347/32

(58) Field of Classification Search
None
See application file for complete search history.

(56) References Cited

U.S. PATENT DOCUMENTS

| | | | | |
|---|---|---|---|---|
| 6,007,177 | A | 12/1999 | Takanaka et al. | |
| 2003/0218652 | A1 * | 11/2003 | Nakashima | 347/31 |
| 2007/0057990 | A1 * | 3/2007 | Yakura et al. | 347/31 |
| 2010/0302310 | A1 * | 12/2010 | Watanabe | 347/32 |

FOREIGN PATENT DOCUMENTS

JP 08-150722 A 6/1996

* cited by examiner

*Primary Examiner* — Lisa M Solomon
(74) *Attorney, Agent, or Firm* — Global IP Counselors, LLP

(57) ABSTRACT

A liquid ejection device includes a head includes a head having a nozzle configured and arranged to eject a liquid, a liquid-receiving section configured and arranged to receive the liquid ejected from the nozzle when flushing is carried out by the head, and a rotating section configured and arranged to rotate the liquid-receiving section. According to this liquid ejection device, printing defects caused by accumulation of a liquid that has been ejected from the nozzle through flushing can be prevented.

3 Claims, 4 Drawing Sheets

LIQUID EJECTION DEVICE AND LIQUID EJECTION METHOD

CROSS-REFERENCE TO RELATED APPLICATIONS

This application claims priority to Japanese Patent Application No. 2010-205230 filed on Sep. 14, 2010. The entire disclosure of Japanese Patent Application No. 2010-205230 is hereby incorporated herein by reference.

BACKGROUND

1. Technical Field

The present invention relates to a liquid ejection device and a liquid ejection method.

2. Related Art

Liquid ejection devices that carry out maintenance referred to as flushing, which involves forcible continuous ejection of ink drops from nozzles in order to eliminate foreign substances or the like adhering to a nozzle face, are known in the prior art (for example, Japanese Laid-Open Patent Application 8-150722).

SUMMARY

When flushing is carried out in such a liquid ejection device, ink which has been ejected towards a flushing box is absorbed into an absorbent material disposed inside the flushing box.

In cases where the ink that has been absorbed into the absorbent material has poor re-dissolvability or re-dispersibility, once the ink dries, the voids of the absorbent material become filled with dried ink, and therefore the absorbent material can no longer absorb ink. For this reason, the ink ejected towards the flushing box accumulates on the absorbent material without being absorbed therein. In some cases, the accumulated ink may contact the nozzle face, giving rise to printing defects.

With the foregoing in view, it is an object of the present invention to prevent printing defects caused by accumulation of a liquid that has been ejected from nozzles through flushing.

In order to address the aforementioned problem, a liquid ejection device according to one aspect of the present invention includes a head having a nozzle configured and arranged to eject a liquid; a liquid-receiving section configured and arranged to receive the liquid ejected from the nozzle when flushing is carried out by the head; and a rotating section configured and arranged to rotate the liquid-receiving section.

Other features of the present invention will be apparent from the disclosure of the present Specification and the accompanying drawings.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
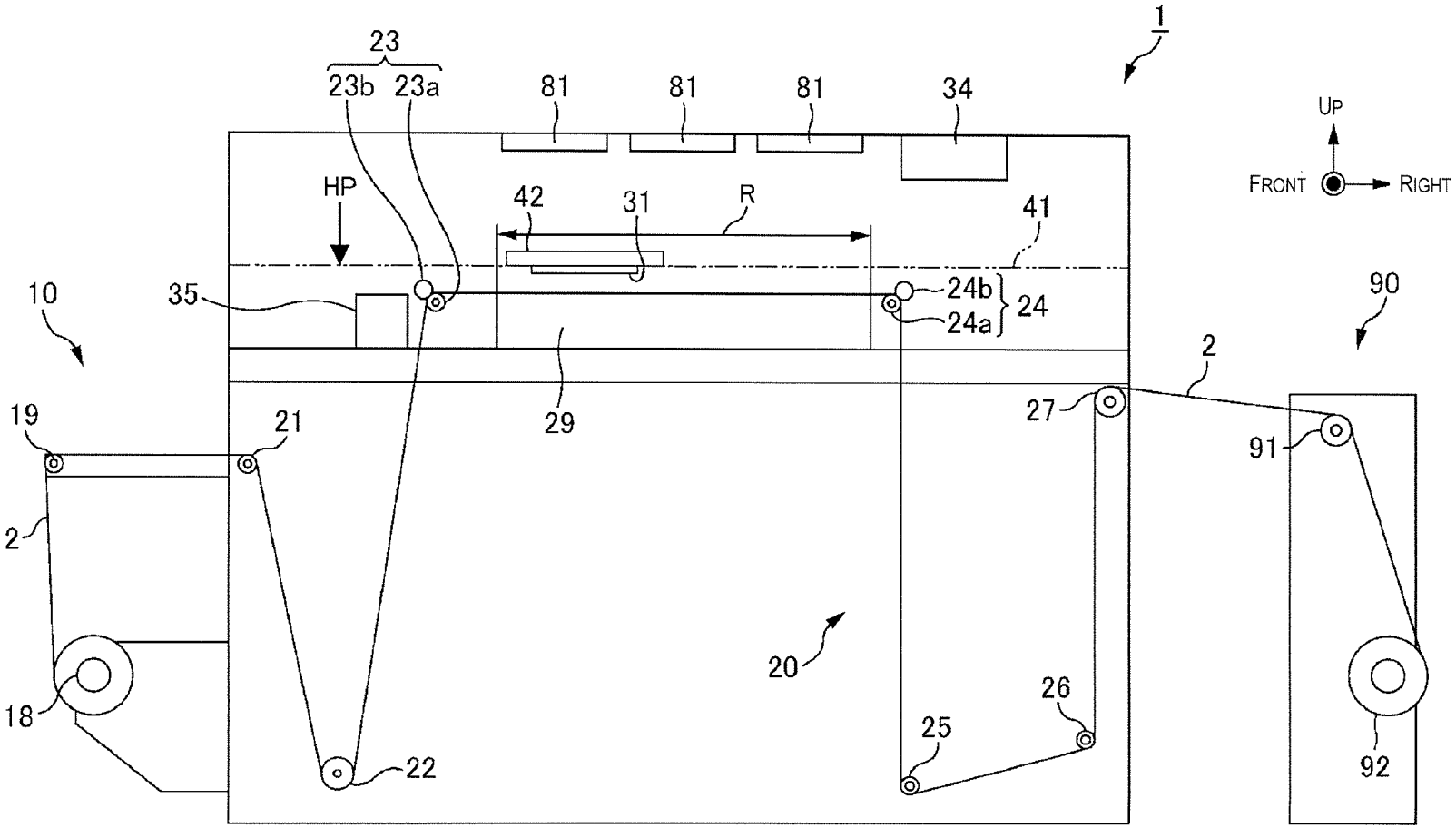
FIG. 1 is a simplified diagram depicting the configuration of a liquid ejection device 1.

The following will be apparent from the matters set forth in the present Specification and the accompanying drawings.

Specifically, a liquid ejection device according to the embodiment of the present invention includes a head having a nozzle configured and arranged to eject a liquid; a liquid-receiving section configured and arranged to receive the liquid ejected from the nozzle when flushing is carried out by the head; and a rotating section configured and arranged to rotate the liquid-receiving section.

According to this liquid ejection device, liquid that has been ejected from the nozzle due to flushing can be deposited over the entire outside peripheral face of the rotating liquid-receiving section, thereby preventing printing defects caused by accumulation of the liquid.

The liquid ejection device may further include a scraping section configured and arranged to abut the liquid-receiving section while the liquid-receiving section rotates to scrape away the liquid received by the liquid-receiving section.

According to this liquid ejection device, liquid that has been deposited onto the liquid-receiving section by flushing can be wiped away, whereby the liquid-receiving section can be restored to the state prior to deposition of the liquid thereon.

In the liquid ejection device, the liquid-receiving section preferably has a cylindrical shape with a curving face so that the liquid ejected downward from the nozzle is received on the curving face.

According to this liquid ejection device, the distance of descent of liquid ejected from the nozzles can be kept constant at any position subsequent to rotation, and therefore the liquid can be deposited in consistent fashion on the liquid-receiving section, while reducing misting (i.e., assuming the form of a mist) of the liquid.

The liquid ejection device may further includes a carriage configured and arranged to travel integrally with the head, and the rotating section is preferably configured and arranged to cause the carriage to travel and engage with the liquid-receiving section to rotate the liquid-receiving section.

According to this liquid ejection device, travel of the carriage may be utilized to bring about rotation of the liquid-receiving section.

A liquid ejection method according to the embodiment is a method for a liquid ejection device including a head having a nozzle configured and arranged to eject a liquid, a liquid-receiving section configured and arranged to receive the liquid ejected from the nozzle when flushing is carried out by the head, and a rotating section configured and arranged to rotate the liquid-receiving section. The liquid ejection method includes carrying out a flushing operation using the liquid ejection device.

According to this liquid ejection method, the liquid ejected from the nozzle by flushing can be deposited over the entire outside peripheral face of the rotating liquid-receiving section, thereby preventing printing defects caused by accumulation of the liquid.

EMBODIMENT

A liquid ejection device 1 according to an embodiment of the present invention is described below.

Configuration Example of Liquid Ejection Device 1

Figure 2:
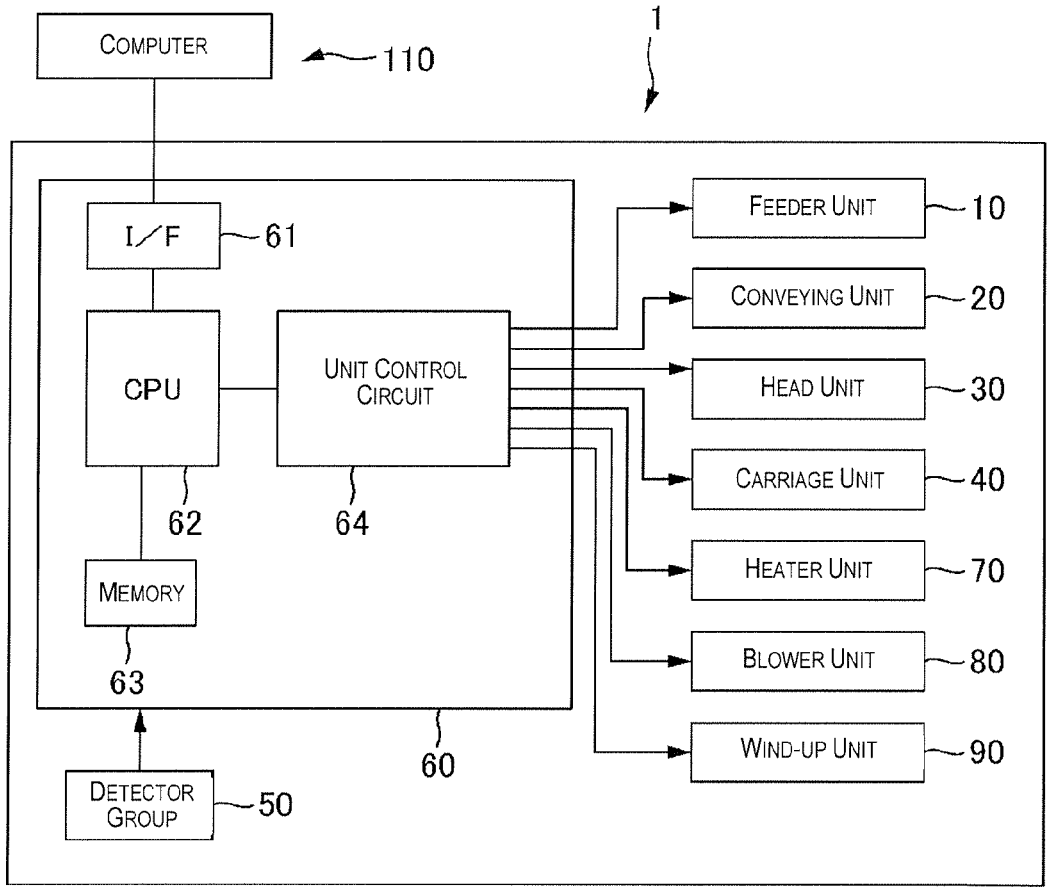
FIG. 2 is a block diagram depicting the configuration of the liquid ejection device 1.

A configuration example of the liquid ejection device 1 is described using FIG. 1 and FIG. 2. FIG. 1 is a simplified sectional diagram of the liquid ejection device 1. FIG. 2 is a block diagram of the liquid ejection device 1.

In the following description, cases where the terms "vertical direction" and "lateral direction" are used make reference to directions depicted by arrows in FIG. 1. Cases where the term "longitudinal direction" is used depict a direction orthogonal to the plane of page in FIG. 1.

In the present embodiment, the liquid ejection device 1 is described as using roll-fed paper (continuous length paper) as the recording medium for recording images.

As depicted in FIG. 1 and FIG. 2, the liquid ejection device 1 according to the present embodiment has a conveying unit 20 as an example of the conveying section; a feeder unit 10 on the conveyance path along which roll-fed paper 2 is conveyed by the conveying unit 20; a platen 29 as an example of a medium supporting section; and a wind-up unit 90; and further has a head unit 30 for carrying out printing in a printing region R on the conveyance path; a carriage unit 40 as an example of a head traveling section; a heater unit 70 as an example of a heat supplying section; a blower unit 80 for blowing air onto the roll-fed paper 2 on the platen 29; a controller 60 for controlling these units and for presiding over operations of the liquid ejection device 1; and a detector group 50.

The feeder unit 10 feeds the roll-fed paper 2 to the conveying unit 20. This feeder unit 10 has a rotatably supported winder shaft 18 onto which the roll-fed paper 2 is wound; and a relay roller 19 around which the roll-fed paper 2 which has been delivered from the winder shaft 18 is looped and directed into the conveying unit 20.

The roll-fed paper 2 advanced by the feeder unit 10 is conveyed along a predetermined conveyance path by the conveying unit 20. As depicted in FIG. 1, this conveying unit 20 has a relay roller 21 positioned horizontally rightward from the relay roller 19; a relay roller 22 positioned to rightward and diagonally downward as seen from the relay roller 21; first conveying rollers 23 positioned rightward and diagonally upward as seen from the relay roller 22 (to the upstream end in the conveyance direction as seen from the platen 29); second conveying rollers 24 positioned rightward as seen from the first conveying rollers 23 (to the downstream end in the conveyance direction as seen from the platen 29); a reversing roller 25 positioned plumb vertically downward as seen from the second conveying rollers 24; a relay roller 26 positioned rightward as seen from the reversing roller 25; and an outfeed roller 27 positioned upward as seen from the relay roller 26.

The relay roller 21 is a roller around which the roll-fed paper 2 advanced from the relay roller 19 is looped from the left side and directed downward while being imparted with slack.

The relay roller 22 is a roller around which the roll-fed paper 2 advanced from the relay roller 21 is looped from the left side and conveyed rightward and diagonally upward.

The first conveying rollers 23 have a first drive roller 23*a* which is driven by a motor, not shown; and a first follower roller 23*b* disposed in opposition to the first drive roller 23*a*, with the roll-fed paper 2 therebetween. These first conveying rollers 23 are rollers adapted to draw upward the roll-fed paper 2 to which slack towards the downward side is imparted, and to convey the paper to the printing region R in opposition to the platen 29. During intervals in which image printing is taking place on an area of the roll-fed paper 2 on the printing region R, the first conveying rollers 23 temporarily halt conveying. Through drive control by the controller 60, the conveyance amount (length of an area of the roll-fed paper) of the roll-fed paper 2 positioned on the platen 29 is adjusted through rotation of the first follower roller 23*b* in association with driving rotation of the first drive roller 23*a*.

As mentioned previously, the conveying unit 20 has a mechanism adapted to convey the roll-fed paper 2 while imparting downward slack to an area thereof which is looped between the relay rollers 21, 22 and the first conveying rollers 23. This slack imparted to the roll-fed paper 2 is monitored by the controller 60 on the basis of a detection signal from a slack detection sensor, not shown. Specifically, in a case where the slack detection sensor has detected an area of the roll-fed paper 2 imparted with slack between the relay rollers 21, 22 and the first conveying rollers 23, because tension of appropriate magnitude is being imparted to the area in question, it is possible for the conveying unit 20 to convey the roll-fed paper 2 in a state imparted with slack. On the other hand, in a case where the slack detection sensor does not detect an area of the roll-fed paper 2 imparted with slack, because tension of excessive magnitude is being imparted to the area in question, the conveying unit 20 temporarily halts conveying of the roll-fed paper 2 and adjusts the tension to the appropriate magnitude.

The second conveying rollers 24 have a second drive roller 24*a* which is driven by a motor, not shown; and a second follower roller 24*b* disposed in opposition to the second drive roller 24*a*, with the roll-fed paper 2 therebetween. These second conveying rollers 24 are rollers that, once an image has been recorded onto the roll-fed paper 2 by the head unit 30, convey an area thereof to the horizontal right direction along the support face of the platen 29, and then subsequently convey the area downward in the plumb vertical direction. The conveyance direction of the roll-fed paper 2 is thereby converted. Through rotation of the second follower roller 24*b* in association with driving rotation of the second drive roller 24*a* by drive control of the controller 60, adjustments are made to a predetermined tension to be imparted to the area of the roll-fed paper 2 positioned over the platen 29.

The reversing roller 25 is a roller about which the roll-fed paper 2 advanced from the second conveying rollers 24 is looped from the upward left side and conveyed rightward and diagonally upward.

The relay roller 26 is a roller about which the roll-fed paper 2 advanced from the reversing roller 25 is looped from the downward left side and conveyed upward.

The outfeed roller 27 is designed such that the roll-fed paper 2 advanced from the relay roller 26 is looped thereabout from the downward left side and fed out to the wind-up unit 90.

Through serial travel of the roll-fed paper 2 through the rollers in this way, there is formed a conveyance path for the purpose of conveying the roll-fed paper 2. The roll-fed paper 2 is conveyed along this conveyance path in intermittent fashion by the conveying unit 20, in unit regions that correspond to the printing region R.

The purpose of the head unit 30 is to eject ink onto an area of the roll-fed paper 2 fed into the printing region R (over the platen 29) on the conveyance path by the conveying unit 20. This head unit 30 has a head 31 and a valve unit 34.

The head 31 has on the bottom face thereof nozzle rows which are respectively composed of a plurality of nozzles #1 to #180 for each of a number of colors such as yellow (Y), magenta (M), cyan (C), and black (K). During flushing, the head 31 carries out flushing of every nozzle row.

The nozzles #1 to #180 of each of the nozzle rows are aligned in linear fashion along a direction intersecting the conveyance direction of the roll-fed paper 2. The nozzle rows are disposed parallel along the travel direction of the head 31 (the scanning direction), with spaces therebetween. The nozzles #1 to #180 are furnished with piezo elements (not shown) as drive elements for the purpose of ejecting ink drops. When a voltage of a predetermined duration is applied across electrodes furnished at both ends, the piezo elements stretch in accordance with the duration of application of voltage, causing the side walls of the ink channels to deform. Because of this, the volume of the ink channels constricts in accordance with expansion and contraction of the piezo elements, and an amount of ink commensurate with this constriction is ejected as an ink drop from the nozzles #1 to #180 of the different colors.

The purpose of the valve unit 34 is to temporarily hold ink, and the unit is connected to the head 31 via an ink supply tube, not shown. Because of this, the head 31 can eject from the nozzles the ink that is supplied to it from the valve unit 34, towards an area of the roll-fed paper 2 which is in a halted state after having been conveyed onto the platen 29, to thereby carry out printing of an image.

The purpose of the carriage unit 40 is to bring about travel of the head 31. This carriage unit 40 has a guide rail 41 (depicted by double-dot and dash lines in FIG. 1) extending in the lateral direction; a carriage 42 supported in a reciprocating traveling manner in the lateral direction (travel direction) along the guide rail 41; and a carriage motor, not shown. In the present embodiment, the carriage motor also functions as a rotating section for rotating a cylindrical pipe 36.

The carriage 42 is configured to travel integrally with the head 31 through driving of the carriage motor, not shown. The position (position in the lateral direction) of the carriage 42 (the head 31 or the nozzle rows) on the guide rail 41 can be derived by having the controller 60 detect the rising edge and the falling edge in a pulse signal output from an encoder which is furnished to the motor, not shown, and counting these edges.

When cleaning of the head 31 is carried out after printing of an image, the carriage 42 travels integrally with the head 31 along the guide rail 41 towards the upstream end in the conveyance direction (the upstream end in the conveyance direction as seen from the platen 29), and comes to a halt at a home position HP where cleaning is carried out (see FIG. 1).

A cleaning unit, not shown, is furnished at the home position HP. This cleaning unit has a cap, a suction pump, etc. With the carriage 42 positioned at the home position HP, the cap, not shown, comes into intimate contact against the lower face (nozzle face) of the head 31. When the suction pump (not shown) is operated with the cap in a state of intimate contact in this way, the ink inside the head 31 is suctioned out together with thickened ink and paper dust. Cleaning of the head is brought to completion through recovery of clogged nozzles from a non-ejecting state in this way.

When flushing of the head 31 is carried out after printing of an image, the carriage 42 travels integrally with the head 31 from the platen 29 end towards the home position HP end. During this time, while traveling together with the carriage 42, the head 31 carries out a flushing operation in a flushing unit 35 which is disposed between the platen 29 and the home position HP. The flushing unit 35 will be discussed in detail below.

The platen 29 supports an area of the roll-fed paper 2 positioned in the printing region R on the conveyance path, and heats the area in question. As depicted in FIG. 1, this platen 29 is furnished in correspondence with the printing region R on the conveyance path, and is disposed in a region along the conveyance path between the first conveying rollers 23 and the second conveying rollers 24. Then, by being supplied with heat generated by a heater unit 70, the platen 29 can heat the area in question of the roll-fed paper 2.

The purpose of the heater unit 70 is to heat the roll-fed paper 2, and the unit has a heater, not shown. This heater has a nichrome wire, and is constituted by disposing the nichrome wire in the interior of the platen 29 in such a way that the distance thereof from the support surface of the platen 29 is constant. Because of this, through energization of the heater, the nichrome wire is caused to emit heat, which heat can be conducted to the area of the roll-fed paper 2 positioned on the support face of the platen 29. Because this heater is constituted by embedding the nichrome wire throughout the entire platen 29, heat can be evenly conducted to the area of the roll-fed paper 2 over the platen 29. In the present embodiment, the area of the roll-fed paper 2 is evenly heated such that the temperature of the area of the roll-fed paper 2 over the platen reaches 45° C. In so doing, the ink that has landed in the area of the roll-fed paper 2 can be caused to dry.

The blower unit 80 is provided with fans 81 as an example of the blowers, and with a motor (not shown) for rotating the fans 81. Through rotation of the fans 81, air is blown onto the roll-fed paper 2 on the platen 29 to bring about drying of the ink that has landed on the roll-fed paper 2. As depicted in FIG. 1, a plurality of the fans 81 are furnished within a recloseable cover (not shown) which is furnished to the chassis section. With the cover closed, each of the individual fans 81 is positioned above the platen 29 and in opposition to the support face of the platen 29 (the roll-fed paper 2 on the platen 29).

The purpose of the wind-up unit 90 is to wind up the roll-fed paper 2 (roll-fed paper on which an image has finished printing) advanced by the conveying unit 20. This wind-up unit 90 has a relay roller 91 around which the roll-fed paper 2 advanced from the outfeed roller 27 is looped from the upward left side and conveyed rightward and diagonally downward; and a wind-up drive shaft 92 for winding up the roll-fed paper 2 advanced from the rotatably supported relay roller 91.

The controller 60 is a control unit for carrying out control of the liquid ejection device 1. As depicted in FIG. 2, this controller 60 has an interface section 61, a CPU 62, a memory 63, and a unit control circuit 64. The purpose of the interface section 61 is to carry out sending and receiving of data between the liquid ejection device 1 and a host computer 110 which is an external device. The CPU 62 is a processing device for carrying out control of the entire liquid ejection device 1. The purpose of the memory 63 is to ensure a region for the CPU 62 to store programs, a work region, etc. The CPU 62 controls the units by the unit control circuit 64, in accordance with a program saved in the memory 63.

The detector group 50, the purpose of which is to monitor circumstances inside the liquid ejection device 1, may be, for example, a rotary encoder attached to a conveying roller and utilized to control conveying of the medium or the like, a paper detection sensor for detecting the presence of a medium being conveyed, a linear encoder for detecting the position of the carriage 42 (or of the head 31) in the travel direction (lateral direction), or the like.

Flushing Unit 35

In the liquid ejection device 1 according to the present embodiment, flushing is carried out in the flushing unit 35.

Flushing is a maintenance process for nozzle recovery, and is intended to prevent loss of ability to eject ink in correct amounts due to nozzles becoming clogged by thickening of the ink in proximity to the nozzle, or to an air bubble becoming entrained inside a nozzle. Specifically, it is an operation whereby a drive signal having no relation to an image to be printed is applied to the drive elements (piezo elements) to forcibly eject ink therefrom. Whereas at times of normal printing, ink is ejected from nozzles selected on the basis of image data, during flushing on the other hand, ink is ejected with no relation to printing, and therefore a large quantity of liquid is ejected towards the flushing unit 35 from a multitude of nozzles (all of the nozzles, or nozzles experiencing ejection defects). Because of this, flushing is the state in which ink mist is most likely to occur.

In conventional liquid ejection devices, the ink ejected towards the flushing box by the head when carrying out flushing is absorbed by an absorbent material disposed inside the flushing box. In so doing, soiling of the nozzle face (nozzle plate) or of the medium due to ink mist occurring during flushing can be prevented.

However, in cases where the ink that has been absorbed into the absorbent material is an ink having poor re-dissolvability or re-dispersibility, once the ink dries, the voids of the absorbent material become filled with dried ink, and therefore the absorbent material can no longer absorb ink. For this reason, the absorbent material no longer performs its function, and the ink ejected towards the flushing box accumulates on the absorbent material without being absorbed therein.

Once ink accumulates on the absorbent material in this way, in some cases the accumulated ink may contact the nozzle face (nozzle plate), and soil or obstruct the nozzles. Because of this, there is a risk of printing defects such as missing dots or the like.

By contrast, with the liquid ejection device 1 according to the present embodiment, instead of having an absorbent material receive and absorb the ink ejected from the nozzles during flushing, the ink receiving section for receiving the ink is caused to rotate so that the ink is deposited over the entire outside peripheral face of the liquid-receiving section. In so doing, the ink which has landed can spread out and dry over the entire outside peripheral face of the liquid receiving sect, whereby printing defects due to accumulation of the ink can be prevented.

Configuration Example of Flushing Unit 35

Figure 3:
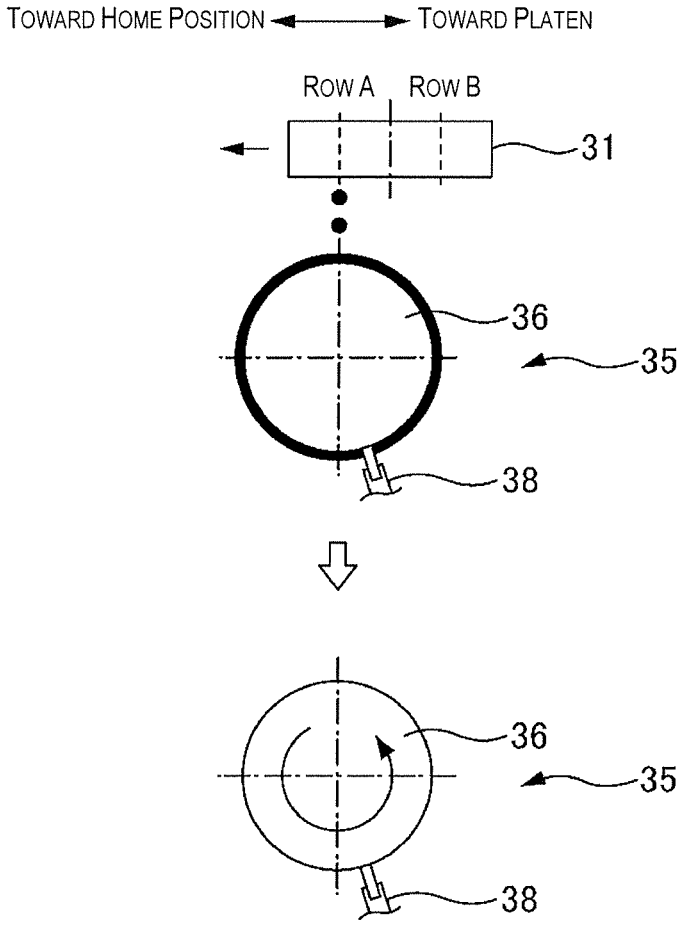
FIG. 3 is a diagram describing a configuration example of a flushing unit 35.
Figure 4A:
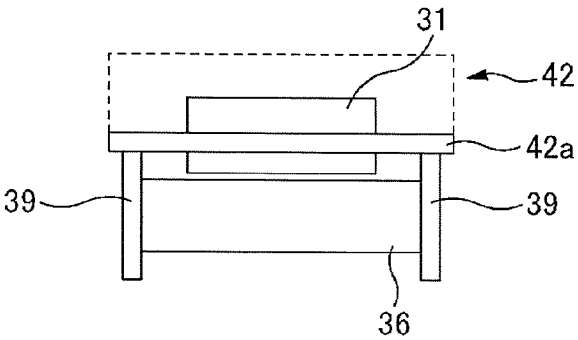
FIG. 4A is a diagram depicting a state with a cylindrical pipe roller 39 in abutment against a base plate 42*a* of a carriage.
Figure 4B:
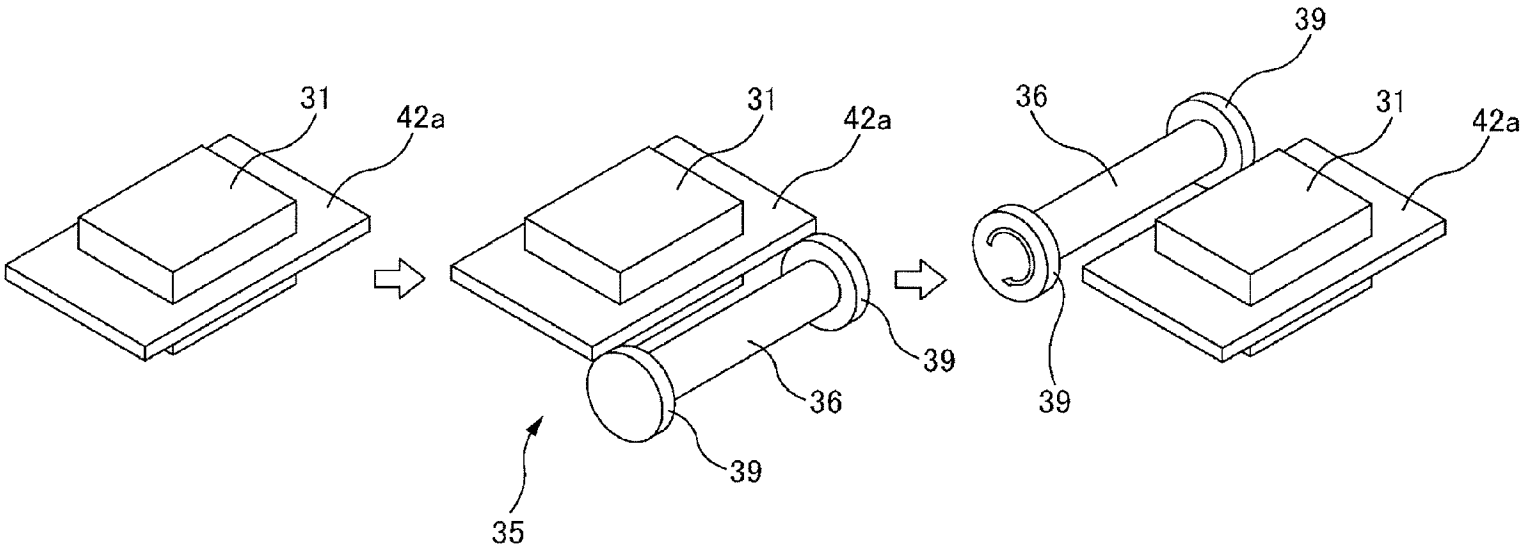
FIG. 4B is a diagram describing rotational operation of a cylindrical pipe 36.

A configuration example of the flushing unit 35 is described using FIGS. 1, 3, and 4. FIG. 3 is a diagram describing a configuration example of the flushing unit 35. FIG. 4A is a diagram depicting a state with a cylindrical pipe roller 39 in abutment against a base plate 42*a* of the carriage. FIG. 4B is a diagram describing rotational operation of a cylindrical pipe 36.

As depicted in FIG. 3, the flushing unit 35 has a cylindrical pipe 36 as an example of the liquid-receiving section, and a scraper 38 as an example of the scraping section. As depicted in FIG. 1, this flushing unit 35 is furnished at the upstream end in the conveyance direction viewed from the platen 29.

The cylindrical pipe 36 is formed to cylindrical shape, and is designed to receive on a curving face the ink drops ejected from the nozzles during flushing. As depicted in FIG. 4A, the cylindrical pipe 36 has rollers 39 at both ends, and rotates integrally with these rollers 39 by the rotating section.

In the present embodiment, as depicted in FIG. 4B, a carriage 42 travels together with the head 31 through driving of a carriage motor as an example of the rotating section, whereupon the cylindrical pipe 36 rotates through abutment of the base plate 42*a* of the traveling carriage 42 against the rollers 39 at the two ends. Specifically, the rotating section brings about rotation of the cylindrical pipe 36 by causing the carriage 42 to travel and engage the cylindrical pipe 36. In so doing, ink ejected from the nozzles by flushing can be deposited over the entire curving face of the rotating cylindrical pipe. 36.

Then, in a state with the roller 39 having abutted the base plate 42*a* of the carriage, a gap forms between the base plate 42*a* of the carriage and the cylindrical pipe 36 (see FIG. 4A). Due to formation of this gap, even after the carriage 42 has traveled and passed above the cylindrical pipe 36, the head 31 traveling integrally with the carriage 42 does not collide with the curving face of the cylindrical pipe 36.

In this way, because the liquid-receiving section in the present embodiment is a cylindrical pipe 36 formed to cylindrical shape, and is moreover constituted to be rotatable by the rotating section, the distance of descent of the ink ejected from the nozzles can be kept constant at any position subsequent to rotation, and the ink can be deposited in consistent fashion over the entire curving face, while reducing misting of the ink.

The purpose of the scraper 38 is to abut the outside peripheral face (curving face) of the rotating cylindrical pipe 36 and thereby scrape away the ink received by the cylindrical pipe 36 (the ink deposited on the curving face). The scraper 38 according to the present embodiment is made of an elastic member of rubber or the like, and as depicted in FIG. 3 abuts the outside peripheral face at the lower side of the cylindrical pipe 36. Because the scraper 38 is detachably mounted, in cases of deterioration of the scraper 38, replacement with another new scraper 38 is possible. Further, an urging mechanism (not shown) is provided for urging the scraper 38 towards the cylindrical pipe 36. Through urging of the scraper 38 by the urging mechanism, the distal edge of the scraper comes in intimate contact against the outside peripheral face of the cylindrical pipe 36. The urging mechanism may also be provided with a mechanism for bringing about travel to a standby position at which the scraper 38 is not urged. In this case, through control of the urging mechanism, the distal edge of the scraper 38 can be separated from the outside peripheral face of the cylindrical pipe 36.

Then, as depicted in FIG. 3, in a state with the scraper 38 abutting the outside peripheral face of the cylindrical pipe 36 under the urging of the urging mechanism, as the cylindrical pipe 36 in a state with ink having been deposited on the outside peripheral face thereof begins to rotate, the cylindrical pipe 36, while rotating, experiences abutment by the scraper 38. Because of this, the ink deposited on the outside peripheral face is scraped away by the scraper 38, so as to be lifted from the outside peripheral face. The ink that was deposited on the outside peripheral face can be eliminated, to restore cylindrical pipe 36 to the state prior to deposition of ink on the outside peripheral face. The ink lifted from the outside peripheral face is held in a box, not shown.

Flushing Operation

Next, the flushing operation using the flushing unit 35 is described using FIG. 3. For convenience, the flushing operation is described using a head 31 having on its lower face two nozzle rows (row A, row B).

The various operations of the liquid ejection device 1 are accomplished primarily by the controller 60. In particular, in the present embodiment, a program saved to the memory 63 is accomplished through processing by the CPU 62. This program is composed of code for carrying out various operations described below.

When a control signal for a flushing operation sent from the host computer 110 is input to the controller 60 via the interface section 61, under the control of the unit control circuit 64, the carriage 42, which is currently positioned in the printing region R, travels along the guide rail 41 from the platen 29 end to the home position HP end. Because this carriage 42 travels integrally with the head 31, the head 31 also travels from the platen 29 end to the home position HP end. Then, under the control of the unit control circuit 64, the head 31 repeatedly carries out a flushing operation for each nozzle row while traveling through the flushing unit 35 disposed between the platen 29 and the home position HP.

Specifically, first, as depicted in FIG. 3, the traveling head 31 carries out flushing for the nozzle row of row A, at the position of shortest linear distance down to the cylinder axis of the cylindrical pipe 36 from the nozzles that form row A. Specifically, at the position in question, the head 31 forcibly ejects ink downward from the nozzles that form row A. Thereupon, the ink drops ejected from the nozzles land on the curving face of the cylindrical pipe 36, and soon dry to form a thin ink layer on the curving surface (ink drops are deposited on the curving face). Next, as it continues to travel, the head 31 carries out flushing in like manner for row B, to complete the flushing operation.

Rotation of Cylindrical Pipe 36

During the time that the flushing operation is carried out with the head traveling integrally with the carriage 42, the cylindrical pipe 36 carries out a rotation operation in coordination with travel of the carriage 42.

Here, rotation of the cylindrical pipe 36 is described using FIGS. 3 and 4B.

First, in order to carry out flushing in the flushing unit 35, the head 31 starts to travel from the platen 29 end to the home position HP end integrally with the carriage 42 (see the left diagram in FIG. 4B). At this time, the carriage 42 travels along the guide rail 41 integrally with the head 31, through driving by the carriage motor which serves as the rotating section.

Next, the head 31 traveling integrally with the carriage 42 gradually approaches the flushing unit 35. Then, as the continuously traveling carriage 42 passes above the cylindrical pipe 36, the base plate 42*a* of the traveling carriage 42 comes into abutment against the rollers 39 at both ends of the cylindrical pipe 36, whereby the cylindrical pipe 36 rotates clockwise (see the center diagram in FIG. 4B).

Specifically, while passing above the cylindrical pipe 36, the head 31 carries out a flushing operation repeatedly for each nozzle row while traveling relative to the cylindrical pipe 36 which is rotating in coordination with travel of the carriage 42.

Because of this, the ink drops that have landed on the cylindrical pipe 36 due to the flushing operation of the head 31 become spread out thinly over the entire curving face of the cylindrical pipe 36, thereby reducing the amount of ink drops per unit surface area and causing the ink drops, whose drying has been accelerated thusly, to be deposited over the entire curving face. As a result, even if dried ink accumulates on the cylindrical pipe 36, because there is no contact thereof with the nozzle face of the head 31, printing defects caused by accumulation of ink can be prevented. Also, because rotation of the cylindrical pipe 36 can be brought about by driving the carriage motor which causes the carriage 42 to travel, there is no need to furnish a dedicated power supply (a motor or the like) for rotating the cylindrical pipe 36. Specifically, travel of the carriage 42 can be utilized to bring about rotation of the cylindrical pipe 36.

The head 31 subsequently passes through the flushing unit 35 and reaches the home position HP (see the right diagram in FIG. 4B).

In this way, with the liquid ejection device 1 in the present embodiment, liquid ejected from nozzles during flushing can be deposited over the entire outside peripheral face of the rotating liquid-receiving section, whereby printing defects caused by accumulation of ink can be prevented.

OTHER EMBODIMENTS

While the present embodiment has primarily set forth a liquid ejection device, the present Specification includes disclosure of a liquid ejection method, etc. The present embodiment is intended merely to aid in understanding the present invention, and should not be construed as limiting the present invention. Modifications and improvements to the present invention may be contemplated without departing from the spirit thereof, and such equivalents will naturally be included within the scope of the present invention. In particular, the embodiments mentioned hereinbelow are included within the scope of the present invention.

Liquid-Receiving Section

In the aforedescribed embodiment, the liquid-receiving section was described in terms of the example of a cylindrical pipe 36, but no limitation thereto is imposed. For example, no limitation is imposed to a receiving member having circular cross sectional shape like the cylindrical pipe 36, and receiving members having circular cross sectional shapes such as semicircular, fan, or elliptical shapes are acceptable as well.

Rotating Section

In the aforedescribed embodiment, the rotating section was described in terms of the example of a carriage motor that causes travel of the carriage 42, but no limitation thereto is imposed.

For example, a dedicated motor for rotating the cylindrical pipe 36 may be furnished separately.

Also, as another example of a rotating mechanism, a belt and pulley mechanism may be used. Specifically, pulleys may be respectively fitted onto the rotating shaft (cylindrical shaft) of the cylindrical pipe 36 and the drive shaft of the motor, and a belt looped around the pulleys. Then, through rotational driving of the motor, the drive power thereof is transmitted to the cylindrical pipe 36 via the belt, causing the cylindrical pipe 36 to rotate.

Liquid Ejection Device

Whereas in the aforedescribed embodiment the liquid ejection device is described in terms of the example of an inkjet printer, no limitation to this is imposed. For example, liquid ejection devices that eject liquids besides ink are also acceptable. Adaptation for use in liquid ejection devices of various types provided with a liquid spraying head or the like for ejecting minutely small drops is also possible. In this case, drop refers to the state in which a liquid is ejected from the liquid ejection device, and includes granular shape, teardrop shape, or filiform shape having a tail. Herein, liquid refers to any material that can be sprayed from a liquid ejection device. For example, any state when a substance is in the liquid phase is acceptable, including not only liquid bodies of high or low viscosity, sols, gel water, or other fluid states such as inorganic solvents, organic solvents, solutions, liquid resins, and liquid metals (molten metals), and liquids containing a single state of a substance, but including also materials in which particles of functional materials composed of solids such as pigments, metal powders, or the like are dissolved, dispersed, or admixed into a medium. Ink, such as described in the aforedescribed embodiment, or liquid crystals, may also be cited as typical examples of liquids. Here, the term "ink" is used in a sense inclusive of ordinary water based inks and oil based inks, as well as various types of liquid compositions such as gel inks, hot-melt inks, and the like. Specific examples of liquid ejection devices include liquid ejection devices for ejecting liquids that contain materials such as electrode materials or coloring matter in dispersed or dissolved form, used for manufacturing, for example, liquid crystal displays, EL (electroluminescence) displays, surface emitting displays, color filters, and the like; liquid ejection devices for ejecting bioorganic compounds for use in biochip manufacture; liquid ejection devices for ejecting specimen liquids and for use as a precision pipettes; textile printing devices; microdispensers; and the like. Further, liquid ejection devices for pinpoint ejection of lubricants into precision instruments such as clocks or cameras; liquid ejection devices adapted to eject solutions of ultraviolet-curing resins or other such transparent resins onto substrates for the purpose of forming very small semi-spherical lenses (optical lenses) for use in optical communication elements or the like; or liquid ejection devices for ejecting acid, alkali, or other etchant solutions for etching substrates and the like may be adopted as well. The present invention may be implemented in any one of these types of liquid ejection device.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid ejection device comprising:

a head having a nozzle configured and arranged to eject a liquid on a recording medium within a printing region along a conveyance path of the recording medium;

a liquid-receiving section disposed outside of the printing region, and configured and arranged to receive the liquid ejected from the nozzle when flushing is carried out by the head outside of the printing region;

a rotating section configured and arranged to rotate the liquid-receiving section; and a scraping section configured and arranged to abut the liquid-receiving section while the liquid-receiving section rotates to scrape away the liquid received by the liquid-receiving section.

2. The liquid ejection device according to claim 1, wherein the liquid-receiving section has a cylindrical shape with a curving face so that the liquid ejected downward from the nozzle is received on the curving face.

3. A liquid ejection device comprising:

a head having a nozzle configured and arranged to eject a liquid on a recording medium within a printing region along a conveyance path of the recording medium;

a liquid-receiving section disposed outside of the printing region, and configured and arranged to receive the liquid ejected from the nozzle when flushing is carried out by the head outside of the printing region;

a rotating section configured and arranged to rotate the liquid-receiving section; and a carriage configured and arranged to travel integrally with the head, the rotating section being configured and arranged to cause the carriage to travel and engage with the liquid-receiving section to rotate the liquid-receiving section.

* * * * *